United States Patent [19]

Ono et al.

[11] Patent Number: 4,903,634

[45] Date of Patent: Feb. 27, 1990

[54] DEVELOPING DEVICE

[75] Inventors: Taizo Ono; Yoshihiro Katayama; Hayato Kamada, all of Osaka; Hidenori Kunishige, Kyoto, all of Japan

[73] Assignee: Matsushita Electric Industrial Co., Ltd., Japan

[21] Appl. No.: 338,522

[22] Filed: Apr. 14, 1989

Related U.S. Application Data

[63] Continuation of Ser. No. 871,753, Jun. 9, 1986, abandoned.

[30] Foreign Application Priority Data

| | | | |
|---|---|---|---|
| Jun. 13, 1985 | [JP] | Japan | 60-128738 |
| Oct. 31, 1985 | [JP] | Japan | 60-244484 |
| Oct. 31, 1985 | [JP] | Japan | 60-244485 |
| Oct. 31, 1985 | [JP] | Japan | 60-244487 |
| Oct. 31, 1985 | [JP] | Japan | 60-244490 |
| Nov. 14, 1985 | [JP] | Japan | 60-255360 |
| Nov. 14, 1985 | [JP] | Japan | 60-255361 |
| Nov. 15, 1985 | [JP] | Japan | 60-256920 |
| Feb. 13, 1986 | [JP] | Japan | 61-29252 |
| Feb. 26, 1986 | [JP] | Japan | 61-41247 |

[51] Int. Cl.[4] ..... G03G 15/08

[52] U.S. Cl. ..... 118/653; 355/259

[58] Field of Search ..... 355/253, 259; 118/653, 118/656; 430/101, 102, 120

[56] References Cited

U.S. PATENT DOCUMENTS

| | | | |
|---|---|---|---|
| 4,083,326 | 4/1978 | Kroll et al. . | |
| 4,155,329 | 5/1979 | Tsukamoto et al. | 118/658 |
| 4,258,116 | 3/1981 | Takasu et al. . | |
| 4,336,318 | 6/1982 | Fukumoto et al. . | |
| 4,378,158 | 3/1983 | Kanbe | 355/14 D X |
| 4,401,740 | 8/1983 | Kawabata et al. . | |
| 4,406,535 | 9/1983 | Sakamoto et al. . | |
| 4,491,408 | 1/1985 | Savage . | |
| 4,492,456 | 1/1985 | Haneda et al. . | |
| 4,521,098 | 6/1985 | Hosoya et al. . | |
| 4,550,998 | 11/1985 | Nishikawa | 355/14 D X |
| 4,567,848 | 2/1986 | Thompson et al. | 118/657 |
| 4,624,545 | 11/1986 | Yasuda et al. | 355/3 DD |
| 4,641,602 | 2/1987 | Kasai | 118/653 |
| 4,686,934 | 8/1987 | Kohyama | 118/656 X |
| 4,743,937 | 5/1988 | Martin | 35/259 |
| 4,760,422 | 7/1988 | Seimiya et al. | 355/253 |

FOREIGN PATENT DOCUMENTS

| | | | |
|---|---|---|---|
| 3143397 | 10/1984 | Fed. Rep. of Germany . | |
| 3438430 | 5/1985 | Fed. Rep. of Germany . | |
| 53-68241 | 6/1978 | Japan | 355/3 DD |
| 53-112753 | 10/1978 | Japan | 355/259 |
| 54-43038 | 4/1979 | Japan . | |
| 56-40861 | 4/1981 | Japan | 355/3 DD |
| 56-110963 | 9/1981 | Japan . | |
| 214178 | 12/1983 | Japan | 355/14 D |
| 229061 | 11/1985 | Japan | 355/3 DD |

*Primary Examiner*—A. T. Grimley
*Assistant Examiner*—J. Pendegrass
*Attorney, Agent, or Firm*—Lowe, Price, LeBlanc, Becker & Shur

[57] ABSTRACT

A developing device for developing a latent electrostatic image for an electrophotographic copying machine includes a cylindrical resilient body such as a fur brush or a roller of sponge for triboelectrically uniformly charging a single component developer of the dry type supplied from a developer storage casing and for coating the developer as a uniform thin layer on a developer carrier such as a developing roller.

21 Claims, 11 Drawing Sheets

DEVELOPING DEVICE

This application is a continuation of application Ser. No. 871,753, filed June 9, 1986, now abandoned.

BACKGROUND OF THE INVENTION

The present invention relates to a developing device for use i an image forming apparatus such as a copying machine, printer, or the like which utilizes the principles of electrophotography.

Dry-type developers or developing powders used in electrophotographic image development are roughly classified into two component developers and single component developers.

The two component developers are a mixture of a carrier and a toner. Therefore, the electrophotographic process employing such a two component developer requires a toner density controlling device for keeping the toner and the carrier mixed at a constant ratio. Another problem of the two component developer is that it should be replaced periodically since the carrier is degraded in use. To eliminate the above drawbacks, there has recently been proposed a developing process for developing latent electrostatic images with a single component developer containing no carrier. Such a developing process is disclosed in Japanese Laid-Open Patent Publication No. 54 (1979)-43038, Japanese Laid-Open Patent Publication No. 56 (1981)-110963, and U.S. Pat. No. 4,083,326, for example. FIGS. 1, 2, and 3 of the accompanying drawings show the developing arrangements disclosed in these prior publications.

FIG. 1 schematically illustrates an image developing device shown in Japanese Laid-Open Patent Publication No. 54(1979)-43038. The device includes a developing roller 1, a hopper 3 housing the developing roller 1 and containing toner 2, a blade 4 attached to the hopper 3, and a photosensitive drum 5. The developing roller 1 is made of metal and has surface irregularities. The developing roller 1 is supplied with the toner 2 from the hopper 3. When the developing roller 1 is rotated in the direction of the arrow, the supplied toner 2 is charged to a given polarity and coated on the pheripheral surface of the developing roller 1 by the blade 4 slidably held against the developing roller 1. The charged toner is then transferred from the developing roller 1 to a latent electrostatic image on the photosensitive drum 5 when the image confronts the developing roller 1, for thereby developing the image into a visible toner image.

As shown in FIG. 2, the developing device disclosed in Japanese Laid-Open Patent Publication No. 58(1981)-110963 includes a photosensitive drum 6, a developing roller 7 of electrically conductive urethane foam held slidably against the photosensitive drum 6, an electrically conductive fur brush 8 held slidably against the developing roller 7, a power supply 9, a voltage regulator 10 for regulating voltages to be applied by the power supply 9 to the fur brush 8 and the developing roller 7, and a hopper 11 containing toner 12. The toner 12 supplied from the hopper 11 to the fur brush 8 is triboelectrically charged by the fur brush 8, and then attracted from the fur brush 8 so as to be coated on the developing roller 7 by the voltage applied by the power supply 9. Thereafter, the toner 12 is applied from the developing roller 7 to a latent electrostatic image on the photosensitive drum 6 to develop the image. If the desired toner density is not achieved on the developed image, then the voltage regulator 10 is operated to control the voltages impressed on the developing roller 7 and the fur brush 8.

The developer applicator apparatus disclosed in U.S. Pat. No. 4,083,326 is illustrated in FIG. 3 of the accompanying drawings. The developer applicator apparatus comprises a developing roller 13, a hopper 15 containing toner 14, a blade 16, a photosensitive sheet 17, electrically conductive fur brushes 18, 19 slidably contacting the developing roller 13, a first power supply 20 for applying a voltage to the fur brush 18, and a second power supply 21 for applying a voltage to the developing roller 13. The voltage applied by the second power supply 21 is of a magnitude greater than the voltage applied by the first power supply 20, but lower than the potential of a latent electrostatic image on the photosensitive sheet 17. The toner 14 that is triboelectrically charged by the fur brush 18 is supplied from the hopper 15 through the fur brush 18 to the developing roller 13 under the potential difference between the first and second power supplies 20, 21. Then, after the toner 14 is adjusted into a thin flat layer by the blade 16, it is applied to the latent electrostatic image on the photosensitive sheet 17 to develop the image. Thereafter, residual toner 14 on the developing roller 13 is scraped off the fur brush 19 to eliminate the developing hysteresis on the developing roller 13.

The conventional developing arrangements are however disadvantageous in that the developer or toner cannot be uniformly charged and cannot be forming into a layer of even thickness on the developing roller, resulting in difficulty in reproducing images of high quality.

More specifically, in the construction shown in FIG. 1, the toner particles in the surface toner layer on the developing roller 1 are triboelectrically charged in contact with the blade 4, but those below the surface toner layer which are not held in contact with the blade 4 are not triboelectrically charged. While the charged toner particles are being transferred from the developing roller 1 to the photosensitive drum 5 for image development, the uncharged toner particles tend to be scattered around, smearing the developing device and fogging the developed image due to toner deposits on the non-image area on the photosensitive drum 5.

With the developing system shown in FIG. 2, the charged toner on the fur brush 8 is attracted onto the developing roller 7 and coated thereon under the electric field between the fur brush 8 and the developing roller 7. The developing system of this design requires a means for uniformly supplying the toner from the hopper 11 to the fur brush 8 since irregular toner coating would take place on the developing roller 7 unless a constant quantity of toner were supplied to the fur brush 8. Even if such a uniform toner supply means is provided, however, coated toner irregularities will still be caused on the developing roller 7 because of density variations of the fur of the fur brush 8, resulting in uneven toner densities on the developed image.

The device shown in FIG. 3 can solve the problems of the arrangements of FIGS. 1 and 2 by uniformly coating the charged toner on the developing roller 13. Nevertheless, the arrangement of FIG. 3 is structurally complex as the two fur brushes 18, 19 are required, one for supplying the toner and one for scraping off the toner. The location in which the developing device can be placed is limited since the toner-containing hopper is disposed below the developing roller 13. In addition, because the fur brushes are caused to rotate in a direction opposite to the direction in which the developing roller 13 rotates at positions where they contact each other, the scraped-off toner is scattered around by the furs of the fur brushes 18, 19 as they spring back out of contact with the developing roller 13. This is problematic since the scattered toner tends to smear the interior of the electrophotographic copying machine or fog the developed image.

SUMMARY OF THE INVENTION

It is an object of the present invention to provide a developing device of a simple construction which reduces limitations on the locations where it can be positioned, which can uniformly charge a developer on a developer carrier and form a developer layer of even thickness on the developer carrier, which prevents toner from being scattered around to guard against contamination of the developing device, and which is capable of producing toner images free of fogging and different toner densitities.

To achieve the above object, a developing device according to the present invention includes a casing for containing a developer, a movable developer carrier mounted in the casing for carrying a developer thereon, a cylindrical resilient body mounted in the hopper means and disposed in a first position confronting the developer carrier for supplying the developer to the developer carrier, means for applying a voltage between the developer carrier and the resilient body to coat a layer of the developer on the developer carrier, a thickness limiting member fixedly disposed on the hopper means for limiting the thickness of the layer of the developer on the developer carrier, the thickness limiting member being disposed in a second position confronting the developer carrier downstream of the first position with respect to the direction in which the developer carrier moves, the casing being arranged to prevent the developer therein from being supplied to an area downstream of the second position and upstream of the first position with respect to said direction.

BRIEF DESCRIPTION OF THE DRAWINGS

The present invention will be described in detail by way of illustrative example with reference to the accompanying drawings, in which.

DETAILED DESCRIPTION

Figure 1:
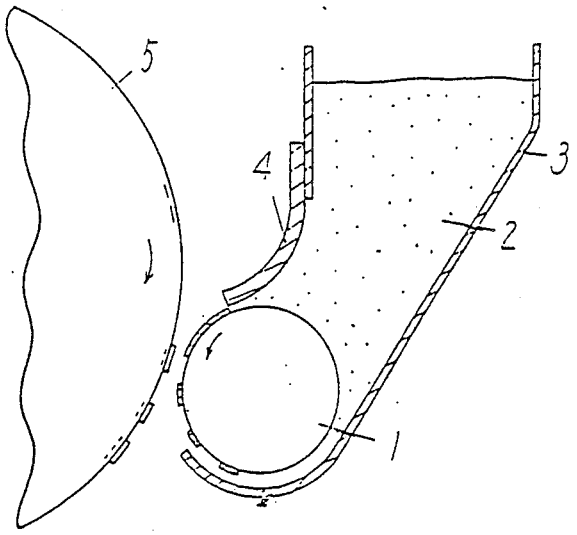
FIG. 1 PRIOR ART
FIGS. 1 through 3 are schematic cross-sectional views of conventional developing devices employing a single component developer.
Figure 2:
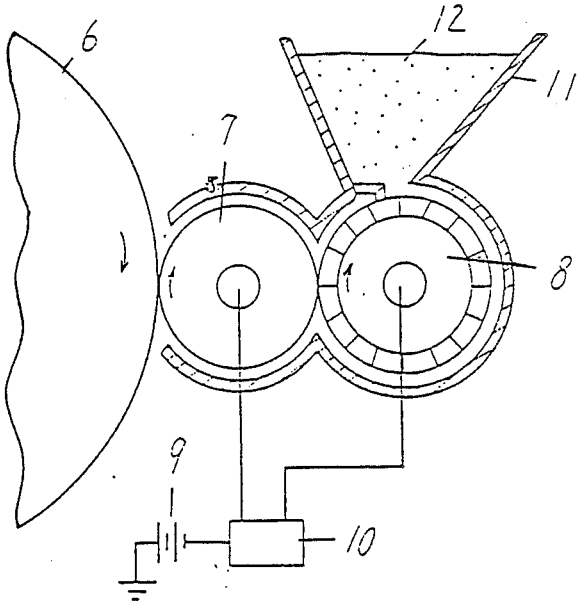
FIG. 2 PRIOR ART
Figure 3:
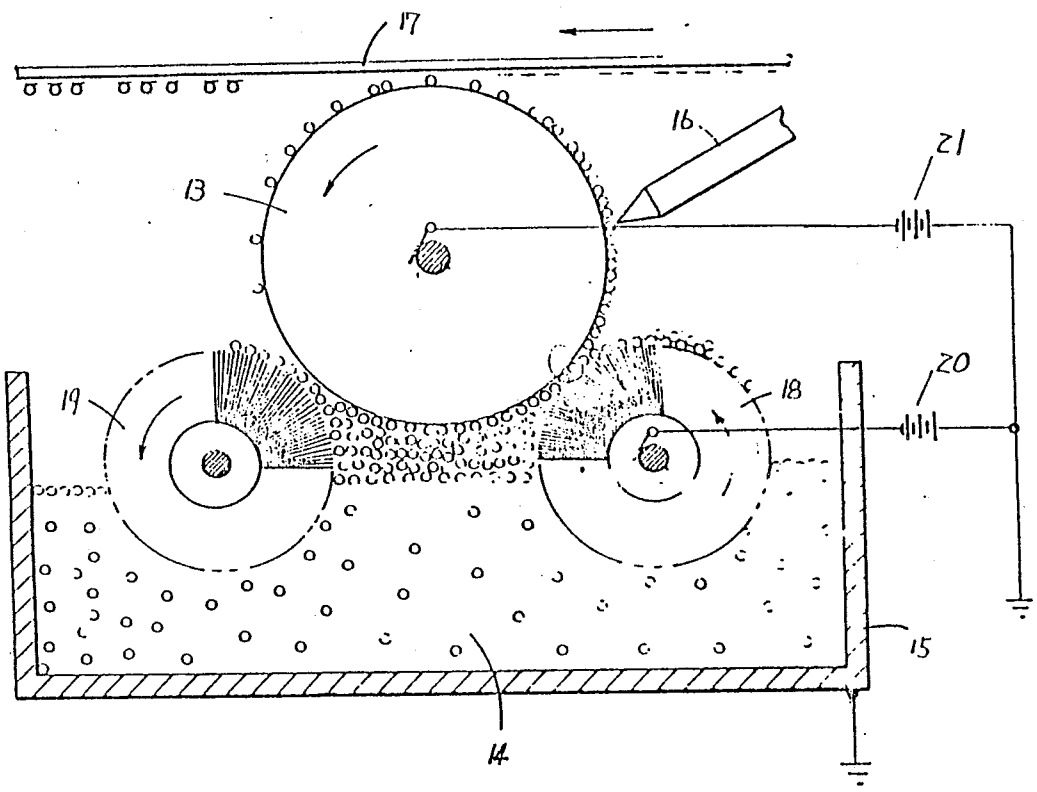
FIG. 3 PRIOR ART

Like or functionally corresponding parts are denoted by like or corresponding reference characters throughout several views.

Figure 4:
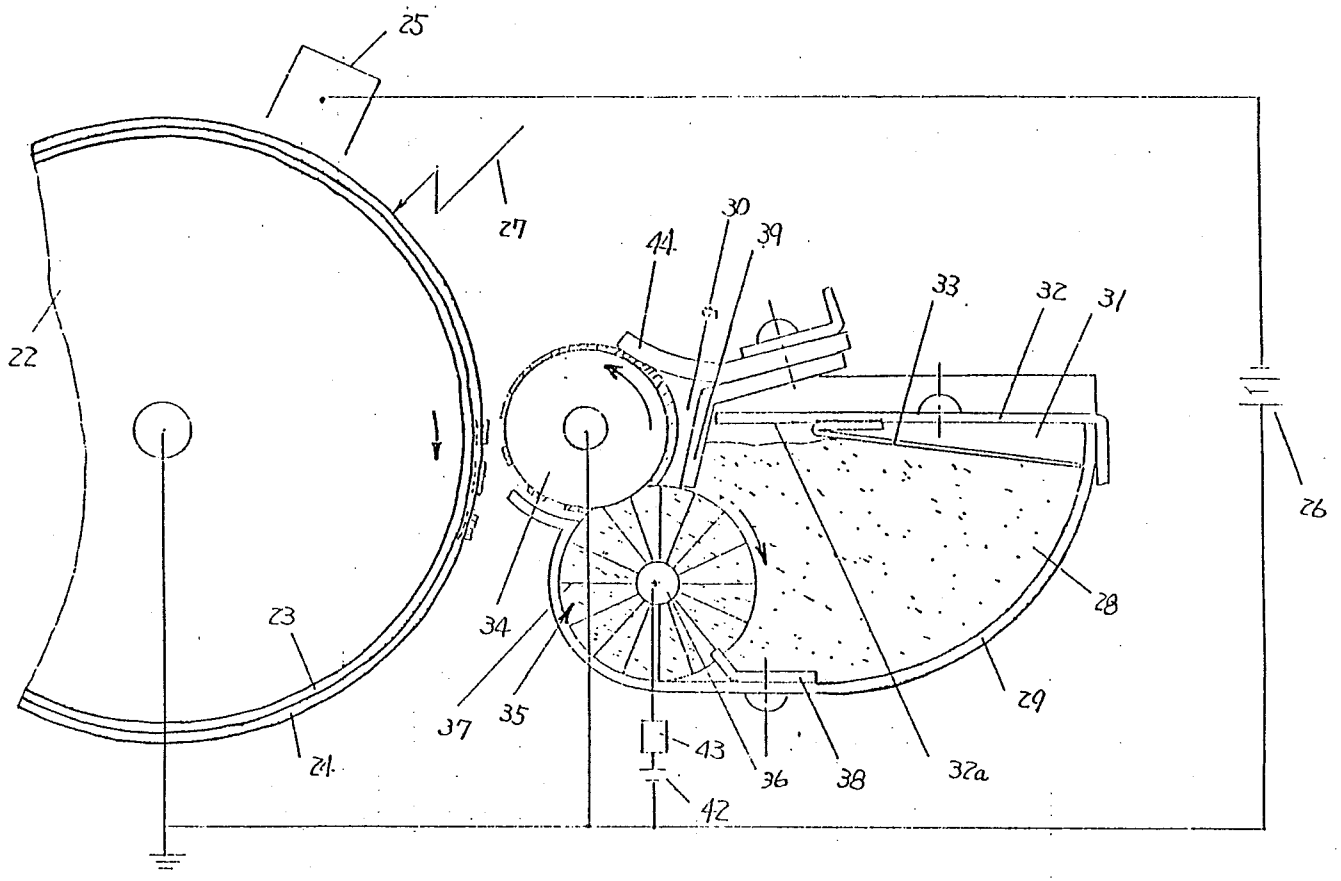
FIG. 4 is a schematic cross-sectional view of a developing device according to a first embodiment of the present invention.
Figure 5:
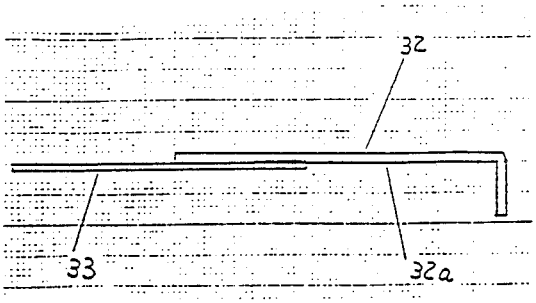
FIG. 5 is a transverse cross-sectional view of a cover in the first embodiment of the invention.

FIGS. 4 through 10 illustrate a developing device according to a first embodiment of the present invention, the developing device being employed for developing images in an electrophotographic copying machine. As shown in FIG. 4, the electrophotographic copying machine includes a latent image carrier 22 which is shown as being a photosensitive drum, but may be an electrostatic recording sheet. The photosensitive drum 22 has a cylindrical base 23 on which a photoconductive layer 24 of zinc oxide, selenium, an organic photoconductive material, or the like is arranged. The photoconductive layer 24 is entirely charged by a charger 25 under a voltage applied by a first DC high-voltage power supply 26. Where the photoconductive layer 24 is made of zinc oxide, a negative corona discharge is applied by the charger 25 to charge the photoconductive layer 24, and where the photoconductive layer 24 is made of selenium, a positive corona discharge is applied by the charger 25 to charge the photoconductive layer 24. A latent electrostatic image is formed on the photosensitive drum 22 by projecting a light pattern image onto the drum 22 through an optical system 27. A developer 28, which may be single-component magnetic or nonmagnetic toner, is contained in a casing 29 having an outlet 30 at one end and a toner supply opening 31 at the opposite end which is covered by a removable cover 32. A resilient sheet 33 disposed in the casing 29 is in the form of a sheet of polyethylene terephthalate or the like, having a thickness of about 40 micrometers, the resilient sheet 33 having one end fixed to an inner side **32*a* of the cover 32. When the cover 32 is removed, the resilient sheet 33 restores its planar configuration under its own resiliency as shown in FIG. 5. When the cover 32 is attached to the casing 29, the resilient sheet 33 is folded on itself up toward the cover 32 within the casing 29 as shown in FIG. 4**.

Figure 6:
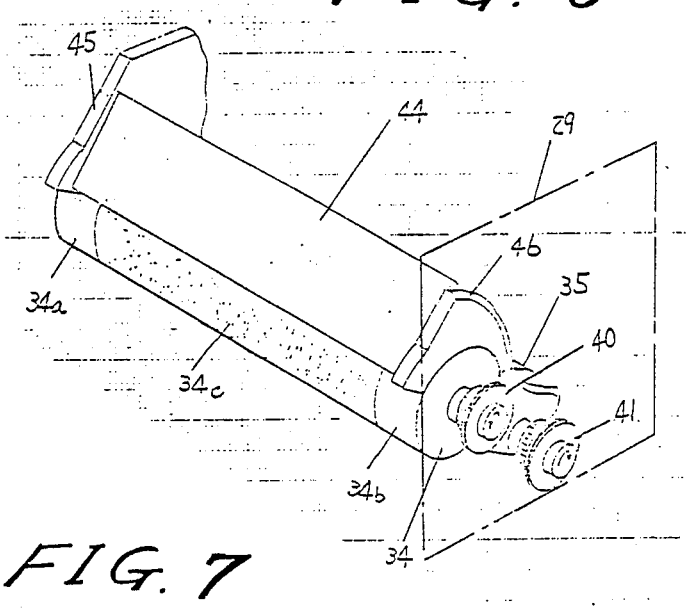
FIG. 6 is a fragmentary perspective view of the developing device of the first embodiment.
Figure 7:
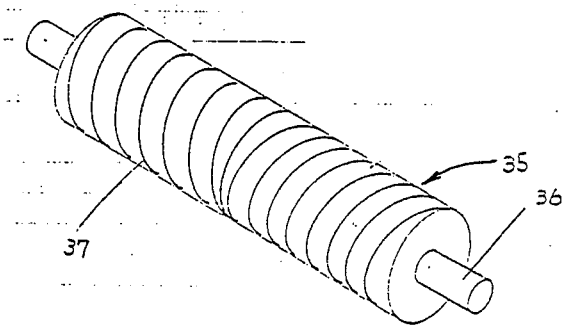
FIG. 7 is a perspective view of a fur brush, serving as a cylindrical resilient body, of the first embodiment.

The developing device includes a developing roller 34 serving as a developer carrier, the developing roller 34 being in the form of a roller of stainless steel, aluminum, or the like, or such a metal roller coated with a resin material. Preferably, as shown in FIG. 6, the developing roller 34 has smooth circumferential surfaces **34*a*, 34*b* on axially opposite ends thereof and a central circumferential surface 34*c* having minute surface irregularities. The developing roller 34 is disposed in the outlet 30 of the casing 29 in spaced-apart relationship to the photosensitive drum 22, the developing roller 34 being rotatable counterclockwise about its own axis as illustrated in FIG. 4. A cylindrical resilient body 35, which may comprise a fur brush, a roller of sponge, or the like, includes an axial core 36 supporting a layer 37 of a resilient material on its outer circumferential surface. In the illustrated embodiment, the cylindrical resilient body 35 is in the form of a fur brush with the resilient material being an electrically conductive fur of rayon fibers containing carbon. The fur brush 35 is rotatably mounted in the casing 29 and held in sliding contact with the circumferential surface of the developing roller 34. For example, the fur brush 35 is rotated clockwise about its own axis at a peripheral speed higher than that of the developing roller 34. As shown in FIG. 7, the fibers of the fur brush 35 are arranged in a spiral pattern for moving the developer 28 from the opposite ends of the fur brush 35 toward the axial center thereof during rotation of the fur brush 35. A scraper plate 38 is fixedly mounted in the casing 29 and held in sliding contact with the fur brush 35 for uniformizing the amount of the developer 28 in the fur brush 35. The fur brush 35 is effective in stirring the developer 28 to triboelectrically charge the developer 28 in cooperation with the sliding contact with the inner surface of the casing 29 and the scraper plate 38. Since the peripheral speed of the fur brush 35 is higher than that of the developing roller 34, the fur brush 35 can scrape off the residual developer 28 from the developing roller 34** after an image development process.

A partition 39 is attached to the casing 29 above the fur brush 35 for preventing the uncharged developer 28 from reaching the area in which the developing roller 34 and the fur brush 35 confront each other, and hence from being trapped in such area. The partition 29 is positioned downstream of the position in which the fur brush 35 and the developing roller 34 confront each other, with respect to the direction in which the fur brush 35 rotates. The developing roller 34 is rotatably supported by bearings 40 (only one shown in FIG. 6), and the fur brush 35 is rotatably supported by bearings 41 (only one shown in FIG. 6).

As illustrated in FIG. 4, a voltage is applied between the developing roller 34 and the fur brush 35 by a second DC high-voltage power supply 42 to coat a layer of the developer 28 on the developing roller 34. The current flowing from the second DC high-voltage power supply 42 is detected by a detector means 43 to ascertain whether the developer 28 is present in the casing 29 and the fur brush 35. The thickness of the developer layer on the developing roller 34 is limited by a blade 44 serving as a thickness limiting means. The blade 44 comprises a rubber blade made of an elastomeric material such as urethane rubber. However, the blade 44 may be made of any of other rubber materials, a resilient synthetic resin such as polyethylene terephthalate, a resilient metal such as phosphor bronze, spring steel, or the like, or such a resilient steel or synthetic resin coated with fluoroplastics. The blade 44 is disposed in a position downstream of the developer 28 in the casing 29, or the position in which the fur brush 35 and the developing roller 34 are held against each other, with respect to the direction in which the developing roller 34 rotates. The blade 44 is pressed against the circumferential surface of the developing roller 34 upstream of the position in which the developing roller 34 confronts the photosensitive drum 22, with respect to the direction in which the developing roller 34 rotates. The blade 44 has such a width (normal to the sheet of FIG. 4) that its opposite ends are held against the outer circumferential surfaces **34*a*, 34*b* at the opposite ends of the developing roller 34, as shown in FIG. 6. Seal members 45, 46 of a resilient material such as felt, sponge, or rubber are held against the outer circumferential surfaces 34*a*, 34*b* of the developing roller 34 and the opposite ends of the blade 44 for preventing the developer 28 from leaking out of the casing 29**.

The fur brush 35 may be made of an electrically insulating material. However, it should preferably be of an electrically conductive material, as described above, having a resistivity of about $10^{10}$ ohm-centimeters or below since if it were made of an electrically insulating material, a higher voltage would have to be applied by the second DC high-voltage power supply 42 between the developing roller 34 and the fur brush 35, and hence the device would be more dangerous and required to be more expensive. The fur brush 35 may be constructed of other electrically conductive fibers rather than the conductive rayon fibers as described above, or may comprise a fur brush fabricated by electrostatic flocking for more uniform coating of the developer 28 on the developing roller 34. The resilient material 37 of the fur brush 35 may also be of electrically conductive sponge, electrically conductive cloth, or a soft wire brush for effective triboelectric charging and coating of the developer 28. Where the developer 28 comprises a single-component magnetic toner, the cylindrical resilient body 35 may comprise a magnetic roller as the axial core 36 with a magnetic brush formed therearound. The casing 29 is shaped to prevent the developer 28 therein from being supplied to an area downstream of the position in which the developing roller 34 and the blade 44 confront each other and upstream of the position in which the developing roller 34 and the fur brush 35 confront each other, with respect to the direction in which the developing roller 34 rotates.

Operation of the developing device according to the first embodiment will be described hereinbelow.

For illustrative purpose only in the following description of operation, the photoconductive layer 24 is made of zinc oxide, the axial core 36 of the fur brush 35 is made of aluminum, the resilient layer 37 is made of rayon fibers having a resistivity of about $10^5$ ohm-centimeters and containing carbon, the rayon fibers having a density of about 3,600 fibers/cm$^2$, the surface roughness of the developing roller 34 is 5 $\mu$mRmax, the blade 44 is pressed against the developing roller 34 under a linear pressure of 25 g/cm, the distance between the photosensitive drum 22 and the developing roller 34 is 0.15 mm, and the developer 28 is an ordinary positively chargeable single-component nonmagnetic toner.

Figure 8:
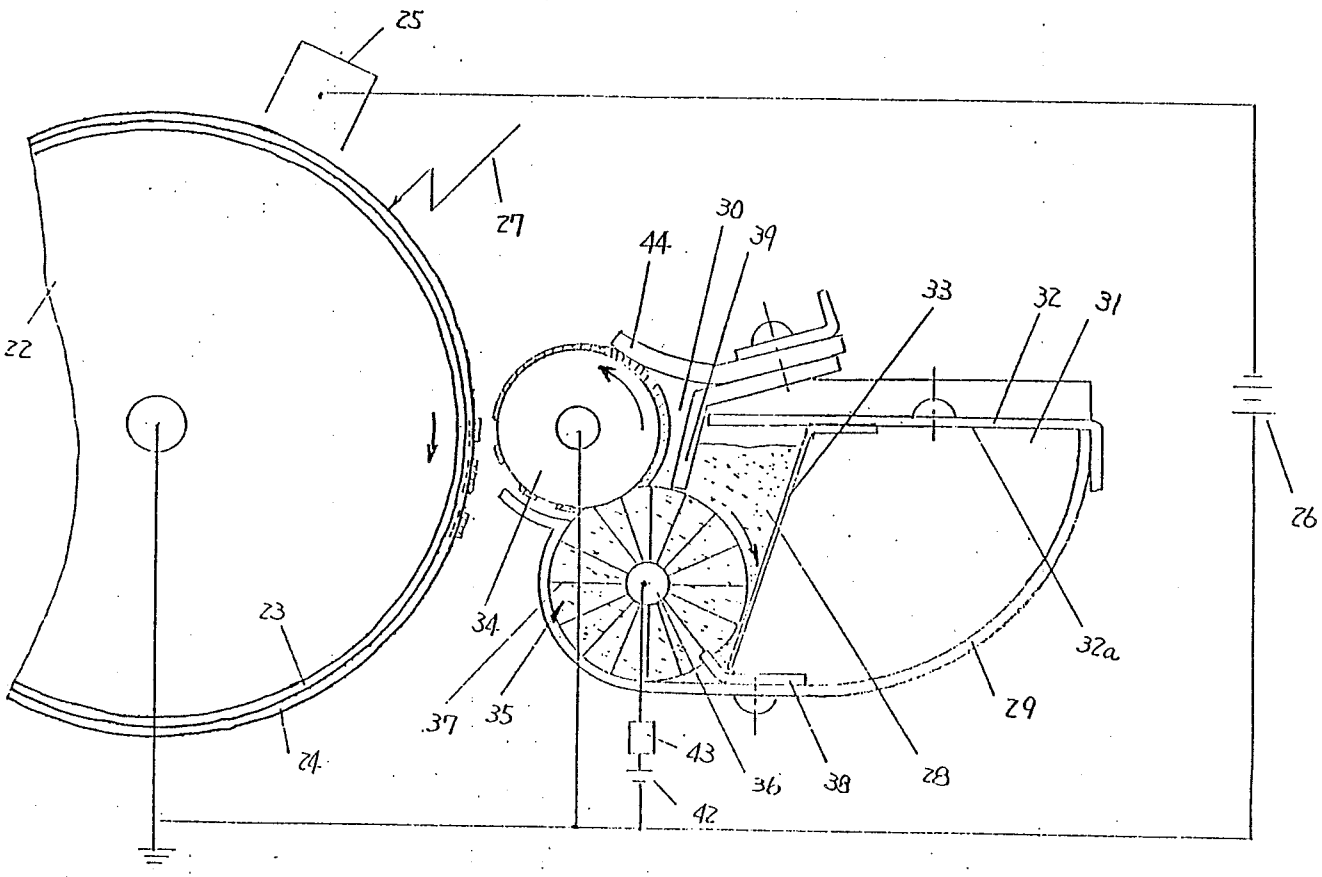
FIG. 8 is a schematic cross-sectional view showing the manner in which a resilient sheet for supplying a developer operates according to the first embodiment.

In FIG. 4, a voltage of about —6 kV is applied by the first DC high-voltage power supply 26 to the charger 25 to negatively charge the entire circumferential surface of the photosensitive drum 22 to about —600 V through a negative corona discharge. The reflected image (optical pattern image) of a document to be copied which is illuminated by a halogen lamp is projected by the optical system 27 onto the negatively charged photosensitive drum 22. The electric charges in the surface area of the photosensitive drum 22 which corresponds to a non-image area of the document are now erased to a residual potential close to about 0 V by the relecting light from the document, thus forming a positive latent electrostatic image on the photosensitive drum 22. During this time, the developer 28 in the casing 29 is supplied into the fur brush 35 as the fur brush 35 is rotated. The developer 28 is supplied to the fur brush 35 in an appropriate quantity since any excessive developer fed to the fur brush 35 is scraped off by the scraper plate 38. The developer 28 supplied to the fur brush 35 is then triboelectrically charged to a positive potential through frictional engagement of the fur brush 35 with the scraper plate 38 and the casing 29. The developer 28 on the fur brush 35 is attracted to the position confronting the developing roller 34 upon continued rotation of the fur brush 35. The developer 28 is further charged positively by being stirred by the fur brush 35 as it rotates and by frictional engagement with the circumferential surface of the developing roller 34. Then, a voltage is applied by the second DC high-voltage power supply 42 between the developing roller 34 and the fur brush 35, with the fur brush 35 being at a positive potential, for thereby coating the charged developer 28 as a layer on the circumferential surface of the developing roller 34. The voltage applied by the second DC high-voltage power supply 42 should preferably be in the range of from 30 V to 250 V, and is 100 V in this embodiment. When the developer 28 is attracted from the fur brush 35 to the developing roller 34 under the electric field produced by the second DC high-voltage power supply 42, uncharged developer particles and developer particles charged in opposite polarity are not attracted, but only properly charged developer particles are selected and transferred for image development. Therefore, resultant developed images are of good quality. Since the appropriate amount of developer 28 is present in the fur brush 35, the contact resistance between the fur brush 35 and the developing roller 34 is high and the current detected by the detector means 43 is low. If no appreciable amount of developer 28 is present in the casing 28 and the fur brush 35 after repeated developing processes, then the contact resistance between the fur brush 35 and the developing roller 34 is reduced and the current detected by the detector means 43 is increased. As a result, the current detected by the detector means 43 is indicative of whether the developer 28 is present in the casing 29 or not. As the developer 28 in the casing 29 is consumed and reduced in quantity through the repetition of developing cycles, the resilient sheet 33 is angularly displaced under its own resilient force as shown in FIG. 8 so that it urges the developer 28 toward the fur brush 35 at all times. Therefore, even where the bottom of the casing 29 is not largely inclined or is kept substantially horizontally, the developer 28 in the casing 29 can substantially entirely be supplied to the fur brush 35. This leads to advantages in that a large amount of developer 28 can be contained in the casing 29 and can reliably be supplied to the fur brush 35 by the resilient sheet 33 which is simple and inexpensive.

Figure 9:
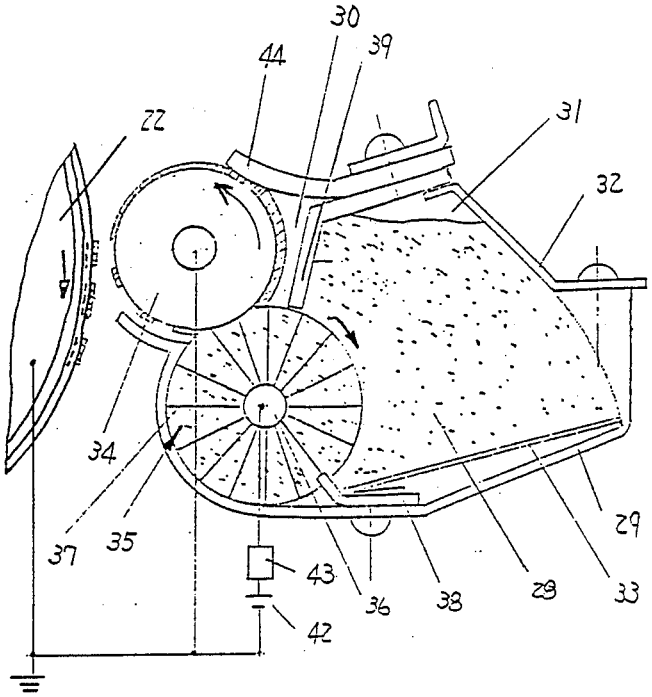
FIGS. 9 and 10 are schematic cross-sectional views of a modified resilient sheet for supplying a developer.
Figure 10:
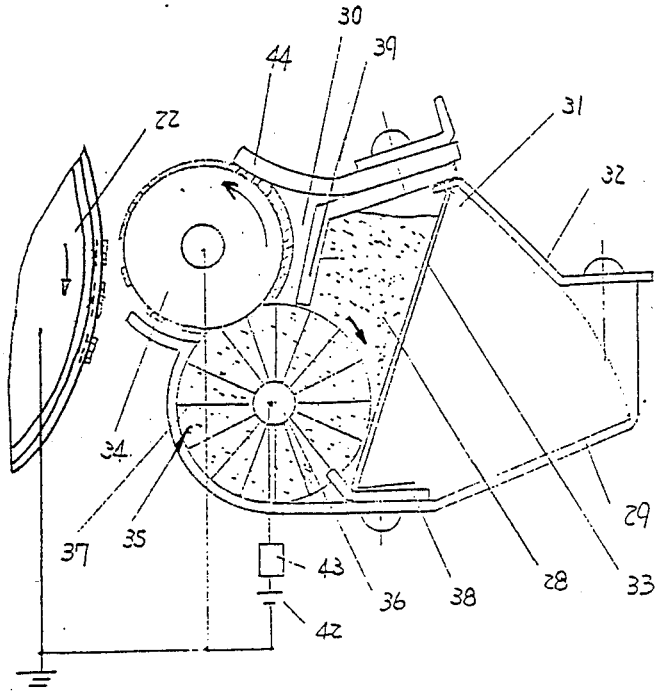

While the resilient sheet 33 is attached to the cover 32 in FIG. 8, the resilient sheet 33 may be attached to the bottom of the casing 29 according to a modification illustrated in FIGS. 9 and 10.

The thickness of the layer of the developer 28 as it is coated on the developing roller 34 by the fur brush 35 is larger than a desired thickness and has certain irregularities. On rotation of the developing roller 34, the charged developer 28 thereon is further charged positively by the blade 44 as the developer 28 goes past the blade 44, while at the same time the developer 28 is partly removed by the blade 44 to a desired thickness ranging from 10 to 70 micrometers, preferably about 40 micrometers according to the embodiment. The developer 28 held against the blade 44 is moved from the central portion of the developing roller 34 toward the oppoiste ends thereof, and then is moved from the opposite ends of the fur brush 35 toward the central portion thereof in response to rotation of the spiral pattern of the fur of the fur brush 35. Therefore, no increased mass of developer 28 is deposited near the opposite ends of the developing roller 34 and the fur brush 35, and hence the height of the developer 28 within the casing 29 is maintained at a constant level. The seal members 45, 46 are subjected to only small wear by continued rotation of the developing roller 34 since the seal members 45, 46 are held against the smooth surfaces **34*a*, 34*b* on the opposite ends of the developing roller 34. The seal members 45, 46 have smooth surfaces contacting the blade 44 and the developing roller 34, and hence provide no gap or clearance between these seal members 45, 46, and the blade 44 and the developing roller 34. Consequently, the developer 28 which is pushed axially outwardly along the developing roller 34 does not leak out along and past the seal members 45, 46. In addition, the developer 28 will not leak out and be scattered around from the casing 29 along the developing roller 34 since the casing 29 has no developer storage space positioned upstream of the position in which the developing roller 34 and the fur brush 35 confront each other, with respect to the direction of rotation of the developing roller 34**.

Therefore, the developing device of the aforesaid embodiment can uniformly charge the developer 28 on the developing roller 34 and uniformize the layer thickness of the developer 28 thereon. The developing device prevents the developer 28 from being scattered around and leaking out, and can produce high-quality images free from fogging and toner density irregularities. Since the developer 28 is coated on the developing roller 34 under the voltage applied by the second DC high-voltage power supply 42, the developer 28 can be charged thereby up to a desired potential within a short period of time, say, 1 sec., and no undue time delay is involved before the developer 28 is charged enough for image development. When the negatively charged latent electrostatic image on the photosensitive drum 22 is moved into confronting relation to the positively charged developer 28 on the developing roller 34, the developer 28 is attracted from the developing roller 34 onto the photosensitive drum 22 under the electrostatic force of the latent electrostatic image on the photosensitive drum 22 for developing the image into a visible toner image. After the image has been developed, the remaining deposit of the developer 28 on the developing roller 34 is scraped off by the fur brush 35 to eliminate the developing hysteresis from the developing roller 34. Therefore, good ghost-free images can successively be developed by the developing device. The developing device of the invention is simple in construction and small in size since the developer is supplied to and scraped off the developing roller by the single fur brush. This structural advantage, in combination with the designs for preventing toner leakage and scattering, reduces limitations on positions in which the developing device can be located.

Figure 11:
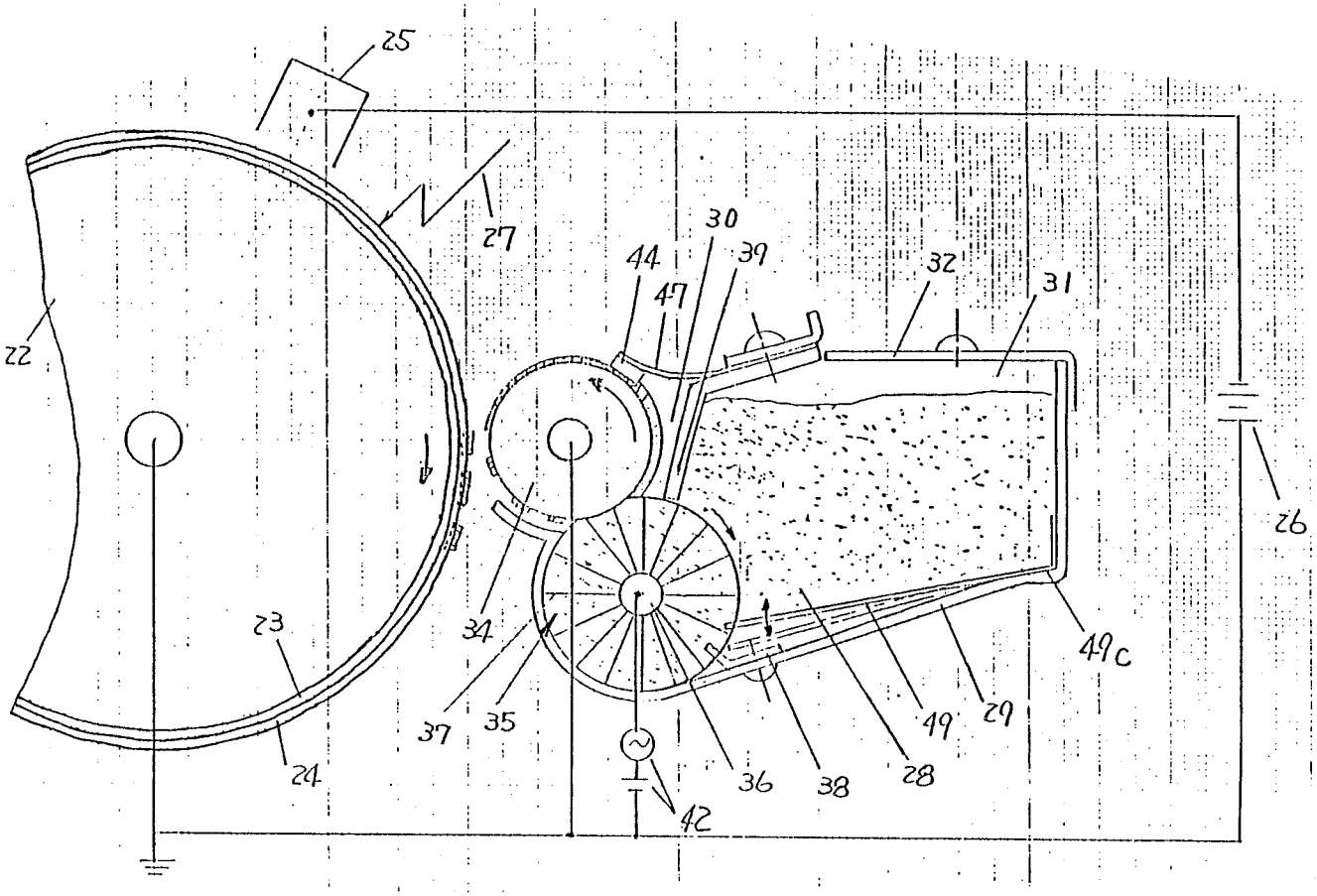
FIG. 11 is a schematic cross-sectional view of a developing device according t a second embodiment of the present invention.
Figure 12:
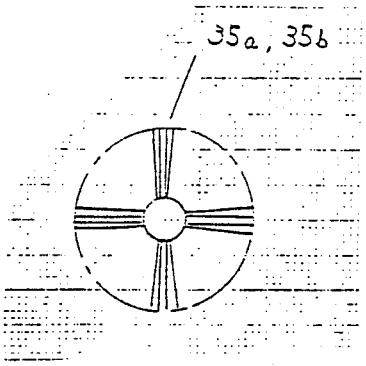
FIG. 12 is an end view of a fur brush, serving as a cylindrical resilient body, of the second embodiment.
Figure 13:
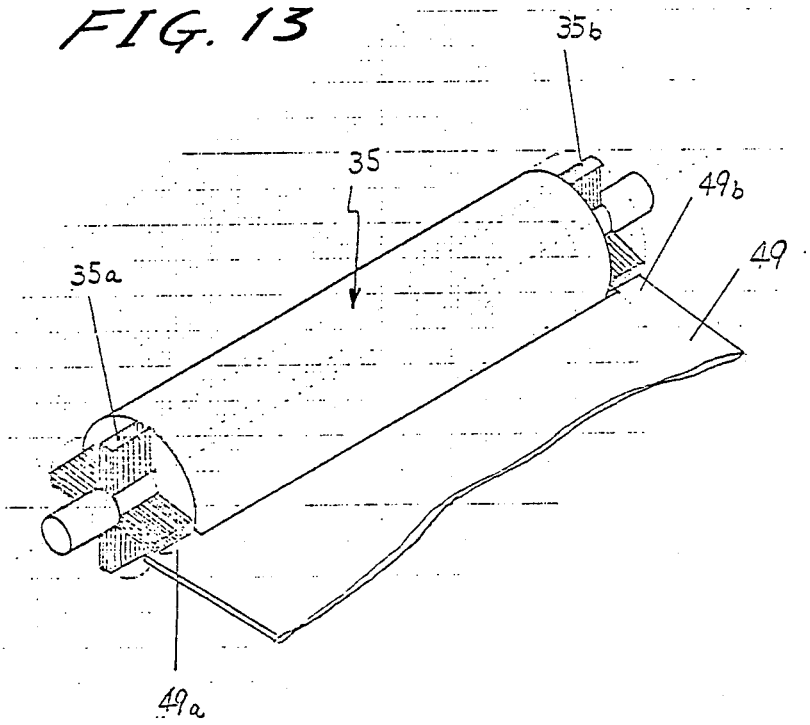
FIG. 13 is a fragmentary perspective view of the fur brush of the second embodiment.

FIGS. 11 through 13 illustrate a developing device according to a second embodiment of the present invention. A thickness limiting member 44 comprises a rigid body of metal such as stainless steel which may be coated with a layer of fluoroplastics, or a body of hard resin or ceramics. The thickness limiting member 44 is supported on a leaf spring 47 and urged against the developing roller 34 under the resiliency of the leaf spring 47. As shown in FIGS. 12 and 13, a fur brush 35 includes opposite ends **35*a*, 35*b* each composed of radial bristles. The fur brush 35 is rotated about its own axis at a peripheral speed lower than that of the developing roller 34. A swingable resilient sheet 49 made of resin, rubber, or in the form of a leaf spring, is disposed in the casing 29. In the illustrated embodiment, the swingable resilient sheet 49 comprises a sheet of polyethylene terephthalate having a thickness of about 70 micrometers. As illustrated in FIG. 13, the resilient sheet 49 has opposite ends 49***a*, 49*b* elongated toward the fur brush 35 and positioned for contact with the opposite ends 35*a*, 35*b* of the fur brush 35. The resilient sheet 49 has an edge 49*c* (FIG. 11) remote from the fur brush 35 and fixed to an inner surface of the casing 29. A second DC high-voltage power supply 42 applies an AC voltage with a positive DC voltage added thereto between the developing roller 34 and the fur brush 35. The other structural details are the same as those of the first embodiment.

The developing device of the second embodiment operates as follows:

Where the thickness limiting means 44 is constructed of a rigid body of metal, it has a smoother surface than a body of rubber. By holding the thickness limiting means 44 of metal against the developing roller 34, a thin uniform layer of developer 28 free of ridges and irregularities can be formed thereby on the developing roller 34. As the peripheral speed of the fur brush 35 is lower than that of the developing roller 34, the fur brush 35 is bent in one direction by the developer 28 in the casing 29 and the scraper plate 38, and then bent in the opposite direction by frictional contact with the developing roller 34, during a developing process. Therefore, the fibers of the fur brush 35 are prevented from being bent over in one direction only, and hence from being folded over permanently. The fur brush 35 is thus effective to stir the developer 28 reliably for the stable development of images of high quality over a long period of time. The swingable sheet 49 vibrates vertically about its fixed edge 49*c* by engagement of the ends 49*a*, 49*b* thereof with the opposite ends 35*a*, 35*b* of the fur brush 35 and under its own resiliency. Even if the bottom of the casing 29 is inclined a small angle to the horizontal direction, the swingable sheet 49 can feed the developer 28 in the casing 29 substantially in its entirety to the fur brush 35. The casing 29 can therefore store an increased amount of developer 28, which can be supplied by the simple and inexpensive swingable sheet 49. With the DC voltage added to the AC voltage by the second DC high-voltage power supply 42, the developer 28 can be coated on the circumferential surface of the developing roller 34 as a layer to a thickness greater than the desired layer thickness. After an image is developed, the residual developer deposit on the developing roller 34 is caused to move back and forth between the fur brush 35 and the developing roller 34 under the AC voltage applied therebetween, so that the developing hysteresis on the developing roller 34 can be erased, and the developer particles are prevented from sticking together and to the developing roller 34. As a consequence, ghost-free images of high quality can repeatedly be produced by the developing device.

Figure 14:
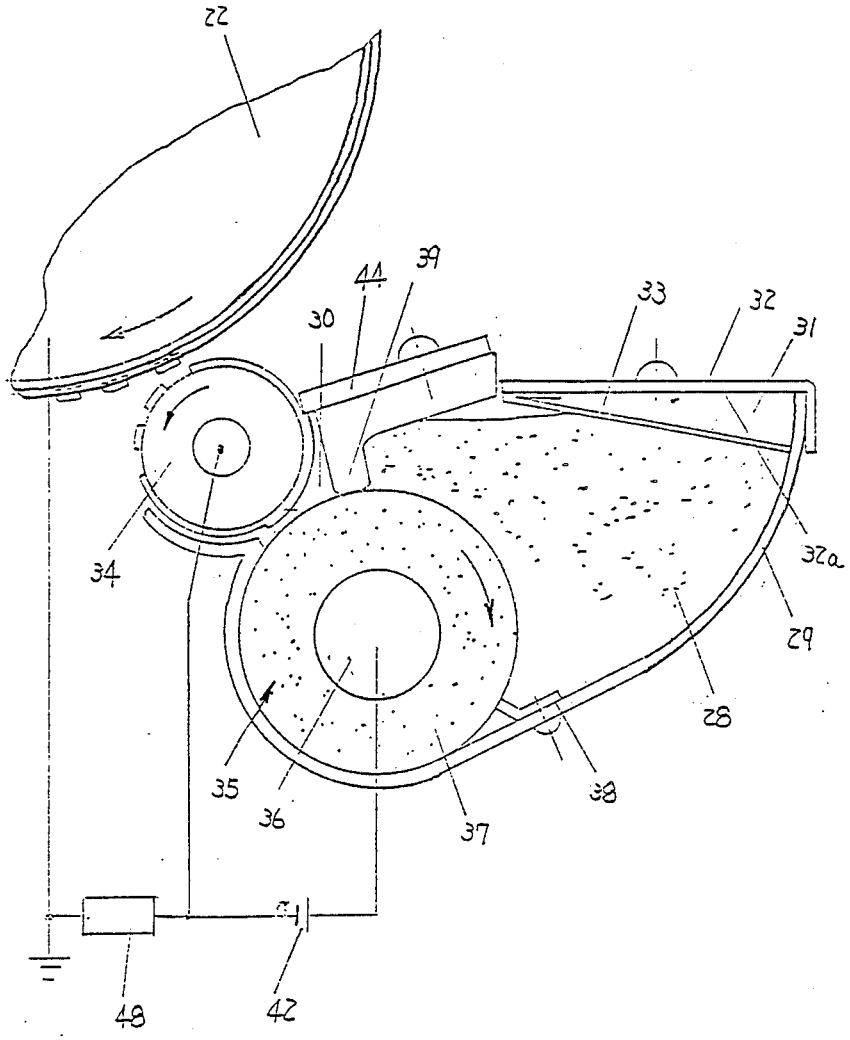
FIG. 14 is a schematic cross-sectional view of a developing device according to a third embodiment of the present invention.

FIG. 14 shows a developing device according to a third embodiment of the present invention. A thickness limiting member 44 comprises a rigid body of metal such as stainless steel which may be coated with a layer of fluoroplastics, or a body of hard resin or ceramics. The thickness limiting member 44 has an end spaced from the circumferential surface of the developing roller 34 by an exact distance equal to the desired layer thickness to which the developer 28 should be coated on the developing roller 34. The resilient layer 37 of the cylindrical resilient body 35 is made of electrically conductive sponge surrounding the axial core 36 of aluminum as a cylindrical roller. It can readily be understood that the resilient layer 37 of electrically conductive sponge can triboelectrically charge and coat the developer 28 as effectively as described with respect to the first embodiment. In the third embodiment, the developing roller 34 and the cylindrical resilient body 35 are closely spaced a distance which is preferably in the range of from 0.1 to 0.5 mm. Such a distance kept between the developing roller 34 and the cylindrical resilient body 35 allows charged developer particles to be separated reliably from uncharged developer particles and developer particles charged at the opposite polarity while the developer 28 is being attracted from the cylindrical resilient body 35 onto the developing roller 34. A DC bias voltage is applied between the photosensitive drum 22 and the developing roller 34 by a bias voltage applying means 48.

Operation of the developing device shown in FIG. 14 will be described below. When the charged developer 28 on the cylindrical resilient body 35 reaches the position confronting the developing roller 34, the developer 28 is coated as a layer on the developing roller 34 to a layer thickness greater than the desired thickness under the electric field produced by the second DC high-voltage power supply 42. On rotation of the developing roller 34, the developer layer thereon is limited by the thickness limiting means 44 to the desired thickness. Then, when the developer layer on the developing roller 34 confronts a latent electrostatic image on the photosensitive drum 22, a DC bias voltage is applied between the photosensitive drum 22 and the developing roller 34 by the bias voltage applying means 48 to develop the latent electrostatic image with the toner. The latent electrostatic image can effectively be developed since the developer 28 is attracted toward the photosensitive drum 22 under the electrostatic force from the latent electrostatic image on the drum 22 and the electric field produced by the DC bias voltage applied between the drum 22 and the developing roller 34. The bias voltage may otherwise be an AC voltage or a combination of a DC voltage and an AC voltage added thereto. Alternatively, the bias voltage applying means 48 may be dispensed with.

Figure 15:
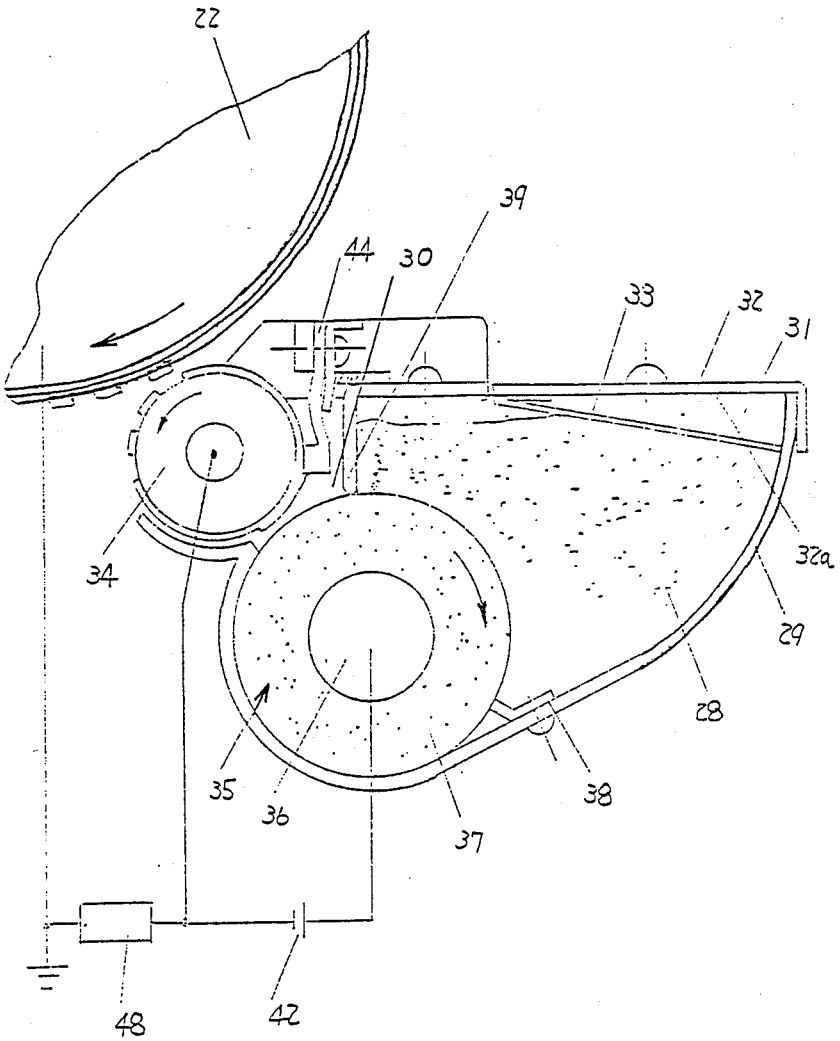
FIG. 15 is a schematic cross-sectional view of a developing device according to a fourth embodiment of the present invention.

FIG. 15 shows a developing device according to a fourth embodiment of the present invention. A thickness limiting means 44 shown in FIG. 15 may comprise a rigid or resilient blade. In this embodiment, however, the thickness limiting means 44 comprises a resilient blade which may be made of the same material as that of the blade 44 according to the first embodiment. The blade 44 of FIG. 15 has one end pressed against the circumferential surface of the developing roller 34 at a position downstream of the position in which the cylindrical resilient body 35 and the developing roller 34 confront each other and upstream of the position in which the photosensitive body 22 and the developing roller 34 confront each other, with respect to the direction in which the developing roller rotates. The other end of the blade 44 is fixed to the casing 29 such that the blade 44 is oriented upstream 34 in a manner to enable the pressed end of the blade 44 to be forced toward the the developing roller 34 under frictional forces imposed on the pressed end on rotation of the developing roller 34. This leads to the advantage of preventing developer particles from sticking together or being solidified on the developing roller 34. The end of the blade 44 which is pressed against the developing roller 34 is of a larger thickness than the rest of the blade 44. Since the developing roller 34 is spaced a larger distance from the rest of the blade 44 as the roller 34 goes past the pressed end of the blade 44, therefore, the charged developer 28 on the developing roller 34 will not be attracted onto the blade 44. Accordingly, the developer 28 is coated on the developing roller 34 as a more uniform layer.

Figure 16:
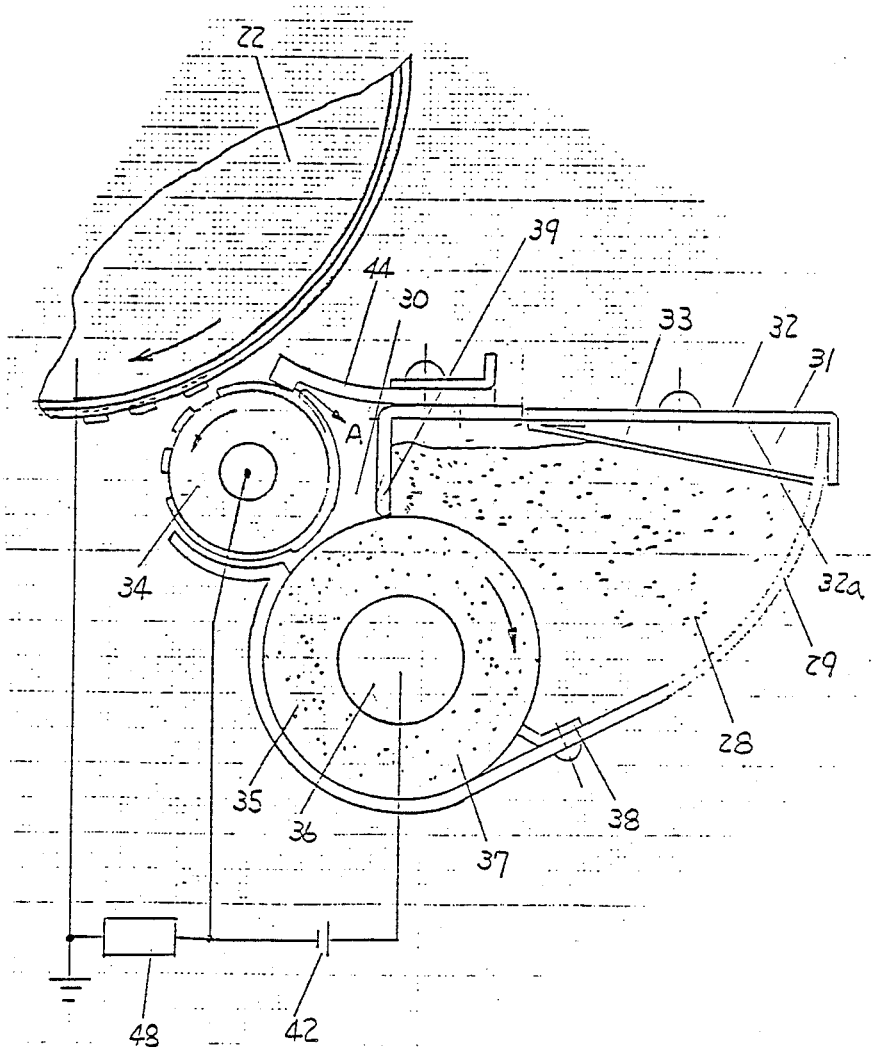
FIG. 16 is a schematic cross-sectional view of a developing device according to a fifth embodiment of the present invention.

A fifth embodiment of the present invention will be described with reference to FIG. 16. A thickness limiting means 44 of FIG. 16 is different from the thickness limiting means 44 of FIG. 15 in that the other end of the blade 44 is fixed to the casing 29 such that the blade is oriented downstream with respect to the direction in which the developing roller 34 rotates in a manner to allow the pressed end of the blade 44 to be forced away from the developing roller 34 under frictional forces imposed on the pressed end on rotation of the developing roller 34. The end of the blade 44 which is pressed against the developing roller 34 is of a larger thickness than the rest of the blade 44. The developer 28 which is collected by the pressed end of the blade 44 on the developing roller 34 changes its direction of flow and then flows in the direction of the arrow A along and away from the thicker end of the blade 44 under the pushing force of the following developer 28 that moves on and with the developing roller 34. The developer 28 flowing in the direction of the arrow A is then caused to fall onto the developing roller 34 above the cylindrical resilient body 35. As a result, the developer 28 continuously recirculates within the space across which the developing roller 34 and the blade 44 confront each other in the vicinity of the pressed end of the blade 44. This reciculating developer 28 just upstream of the pressed end of the blade 44 provides a continuous supply of the developer 28 which ensures uniform formation of a developer layer on the developing roller 34 past the pressed end of the blade 44.

The various components of the developing devices according to the aforesaid five embodiments may be combined in other numerous ways than illustrated above. The developing device of the invention is highly suitable for use with non-magnetic single component developers. The developing device does not cause fogging on developed images since the developing device is held out of direct physical contact with the latent image carrier or photosensitive drum. As an image is developed by a non-magnetic single component developer which is attracted from the developing roller onto the latent image carrier under a DC electric field, the developing device of the invention is also of advantage when used to form colored images which are developed by applying developers of different colors to the latent image carrier.

Although certain preferred embodiments of the present invention have been shown and described in detail, it should be understood that various changes and modifications may be made therein without departing from the scope of the appended claims.

What is claimed is:

1. A developing device for visualizing a latent electrostatic image formed on a latent image carrier, comprising:

a casing for containing a developer, said casing having an outlet at one end thereof;

an endless movable developer carrier for carrying the developer thereon, said developer carrier being disposed in said casing outlet;

means for charging the developer, said charging means comprising a cylindrical resilient body rotatably mounted in said casing in confronting relation to the developer carrier;

means for transferring and coating the charged developer as a layer onto said developer carrier under an electric field;

means for limiting the thickness of said layer of developer on said developer carrier to a prescribed thickness; and a swingable resilient sheet having one end fixedly mounted in said casing and the other end held in contact with the outer circumferential surface of said cylindrical resilient body, said swingable resilient sheet being vibratable under its own resiliency on rotation of said cylindrical resilient body;

said transferring and coating means and said thickness limiting means being successively disposed in the direction in which said developer carrier moves; and said charging means, said transferring and coating means and said developer carrier being arranged such that only the developer which passes through said charging means is supplied to said developer carrier.

2. A developing device for visualizing a latent electrostatic image formed on a latent image carrier, comprising:

a casing containing developer therein and provided with an outlet;

an endless movable developer carrier arranged in the outlet of the casing for carrying the developer thereon;

a rotatable cylindrical charging body arranged within the casing so that a portion of the casing surrounds part of the cylindrical charging body and adjacent the developer carrier for charging the developer and supplying charged developer adjacent the developer carrier, the developer carrier being arranged between the cylindrical charging body and the outlet of the casing, the cylindrical charging body being arranged between the developer carrier and the developer contained within the casing, the developer carrier and the cylindrical charging body being movable in a common direction at a position where the developer carrier and the cylindrical charging body are in contact, the peripheral speed of the cylindrical charging body being higher than the peripheral speed of the developer carrier, the cylindrical charging body being operative to transfer the charged developer to the developer carrier and to coat the charged developer as a layer on said developer carrier, and the part of the cylindrical resilient body which is surrounded by the casing rotating in a direction from a bottom of the casing toward the developer carrier; and means for limiting the thickness of said layer of the developer on said developer carrier to a prescribed thickness, said thickness limiting means being arranged downstream of the position where the developer is transferred from the cylindrical charging body to the developer carrier with respect to the direction in which the developer carrier moves.

3. The developing device of claim 2, wherein developer carried on the developer carrier and the latent image carrier are out of contact with each other.

4. The developing device of claim 2, further comprising means for applying a DC electric field between the developer carrier and the latent image carrier.

5. The developing device of claim 2, further comprising a partition extending at a position downstream, with respect to a direction of rotation of the cylindrical resilient body, of the position where the cylindrical resilient body and the developer carrier oppose each other, the partition preventing uncharged developer from reaching the position where the cylindrical resilient body and the developer carrier oppose each other.

6. The developing device of claim 2, further comprising:

a scraper plate held in slidable contact with the cylindrical resilient body for scraping off an excessive amount of the developer from the cylindrical resilient body and uniformly providing the developer on the cylindrical resilient body.

7. The developing device of claim 2, wherein the developer carrier and the cylindrical resilient body are made of electrically conductive material, and wherein the developing device comprises means for applying an electric potential between the developer carrier and the cylindrical resilient body.

8. The developing device of claim 7, wherein the electric potential includes a superposition of an AC voltage and a DC voltage.

9. The developing device of claim 2, wherein the developer carrier and the cylindrical resilient body are made of electrically conductive material, and wherein the developing device further comprises means for applying an electric potential between the developer carrier and the cylindrical resilient body, and means for sensing a current caused by the application of the electric potential.

10. A developing device for visualizing a latent electrostatic image formed on a latent image carrier, comprising:

a movable endless developer carrier carrying a developer thereon, the developer carrier opposing the latent image carrier;

a rotatable cylindrical resilient body contacting the outer circumferential surface of the developer carrier, the developer carrier and the cylindrical resilient body being movable in a common direction at a position where the developer carrier and the cylindrical resilient body are in contact, the peripheral speed of the cylindrical resilient body being higher than the peripheral speed of the developer carrier;

means for limiting a layer of the developer to a prescribed thickness, the developer layer extending on the developer carrier in a region downstream, with respect to a direction of movement of the developer carrier, of a position where the developer carrier and the cylindrical resilient body oppose each other, and upstream of a position where the developer carrier and the latent image carrier oppose each other;

means for supplying the developer to an outer circumferential surface of the cylindrical resilient body at a position distant from the position where the developer carrier and the cylindrical resilient body oppose each other; and a casing accommodating the developer and the supplying means, wherein a portion of the casing surrounds part of the outer circumferential surface of the cylindrical resilient body extending between the supplying means and the developer carrier and wherein the part of the cylindrical resilient body which is surrounded by the casing rotates in a direction from a bottom of the casing toward the developer carrier.

11. The developing device of claim 10, wherein the developer carried on the developer carrier and the latent image carrier are out of contact with each other.

12. The developing device of claim 10, further comprising means for applying a DC electric field between the developer carrier and the latent image carrier.

13. The developing device of claim 10, further comprising a partition extending at a position downstream, with respect to a direction of rotation of the cylindrical resilient body, of the position where the cylindrical resilient body and the developer carrier oppose each other, the partition preventing uncharged developer from reaching the position where the cylindrical resilient body and the developer carrier oppose each other.

14. The developing device of claim 10, further comprising a scraper plate held in slidable contact with the cylindrical resilient body for scraping off an excessive amount of the developer from the cylindrical resilient body and uniformly providing the developer on the cylindrical resilient body.

15. The developing device of claim 10, wherein the developer carrier and the cylindrical resilient body are made of electrically conductive material, and wherein the developing device further comprises means for applying an electric potential between the developer carrier and the cylindrical resilient body.

16. The developing device of claim 15, wherein the electric potential includes a superposition of an AC voltage and a DC voltage.

17. The developing device of claim 10, wherein the developer carrier and the cylindrical resilient body are made of electrically conductive material, and wherein the developing device further comprises means for applying an electric potential between the developer carrier and the cylindrical resilient body, and means for sensing a current caused by the application of the electric potential.

18. The developing device of claim 10, wherein the limiting means comprises a blade having first and second ends, the first end forming a pivot and the second end being in press contact with the developer carrier, the pivot being positioned to drive the blade toward the developer carrier by a frictional force acting on the second end during movement of the developer carrier, the second end having a projection.

19. The developing device of claim 10, wherein the limiting means comprises a blade having first and second ends, the first end forming a pivot and the second end being in press contact with the developer carrier, the pivot being positioned to drive the blade away from the developer carrier by a frictional force acting on the second end during movement of the developer carrier, the second end having a projection.

20. A developing device for visualizing a latent electrostatic image formed on a latent image carrier, comprising:

a casing accommodating a developer, an end of the casing having an outlet;

an endless developer carrier positioned at the outlet of the casing and carrying the developer thereon;

a rotatable cylindrical resilient body contacting an outer circumferential surface of the developer carrier;

means for limiting a layer of the developer to a prescribed thickness, the developer layer extending on the developer carrier in a region downstream, with respect to a direction of movement of the developer carrier, of a position where the developer carrier and the cylindrical resilient body oppose each other; and a resilient sheet extending in the casing and having first and second ends, the first end being fixed to the casing, the second end engaging the developer, the resilient sheet driving the developer toward the cylindrical resilient body.

21. A developing device for visualizing a latent electrostatic image formed on a latent carrier, comprising:

a casing accommodating a developer, an end of the casing having an outlet;

an endless developer carrier positioned at the outlet of the casing and carrying the developer thereon;

a rotatable cylindrical resilient body contacting an outer circumferential surface of the developer carrier; and a resilient sheet extending in the casing and having first and second ends, the first end being fixed to the casing, the second end engaging the developer, the resilient sheet swinging in response to rotation of the cylindrical resilient body.

* * * * *